United States Patent [19]

Klundt

[11] Patent Number: 4,923,426

[45] Date of Patent: May 8, 1990

[54] BUBBLE BEARD TOY

[75] Inventor: Kalvin K. Klundt, Louisville, Ky.

[73] Assignee: K & A Design, Louisville, Ky.

[21] Appl. No.: 383,187

[22] Filed: Jul. 20, 1989

[51] Int. Cl.[6] ..... A63H 33/28

[52] U.S. Cl. ..... 446/19; 446/15; 239/145

[58] Field of Search ..... 496/15, 16, 17, 18, 496/19, 20, 21; 222/187; 239/53, 145

[56] References Cited

U.S. PATENT DOCUMENTS

| | | | |
|---|---|---|---|
| 565,332 | 8/1896 | Daugherty | 446/20 |
| 688,376 | 12/1901 | Alhart | 446/20 |
| 1,115,556 | 11/1914 | Little | 446/19 |
| 2,118,748 | 5/1938 | Warham | 446/19 |
| 2,205,028 | 6/1940 | Bloxom | 446/19 |
| 2,711,051 | 6/1955 | Pick . | |
| 3,428,222 | 2/1969 | Wright | 222/187 |
| 3,443,337 | 5/1969 | Ehrlich | 446/19 |
| 3,590,515 | 7/1971 | Clark . | |
| 3,745,693 | 7/1973 | Lafata et al. | 446/15 |
| 3,769,833 | 11/1973 | Ordway et al. | 446/15 X |
| 3,848,355 | 11/1974 | Weight | 496/17 |
| 3,946,762 | 3/1976 | Green | 239/145 X |
| 4,292,754 | 10/1981 | Lukaszewski . | |
| 4,411,095 | 10/1983 | Rushing et al. . | |
| 4,606,731 | 8/1986 | Span . | |

*Primary Examiner*—Robert A. Hafer
*Assistant Examiner*—Sam Rimell
*Attorney, Agent, or Firm*—Amster, Rothstein & Ebenstein

[57] ABSTRACT

Apparatus for producing from a bubble solution a beard of long, interconnected bubble chains comprises a hollow elongate tube having opposite ends and a sidewall connecting the opposite ends. The tube has at one end a first portion adapted to receive a gas and at the opposite end a second portion defining at least one aperture extending through the sidewall and in gaseous communication with the first portion. A porous cloth is disposed over and about each of the apertures, the cloth defining a multiplicity of substantially minute interstices for holding thin films of bubble solution. Gas introduced at the one tube end passes through the first tube portion, into the second tube portion, and emerges from the apertures through the bubble solution held in the cloth to form a beard of bubbles extending about and along substantially the entire length of the second portion sidewall.

25 Claims, 2 Drawing Sheets

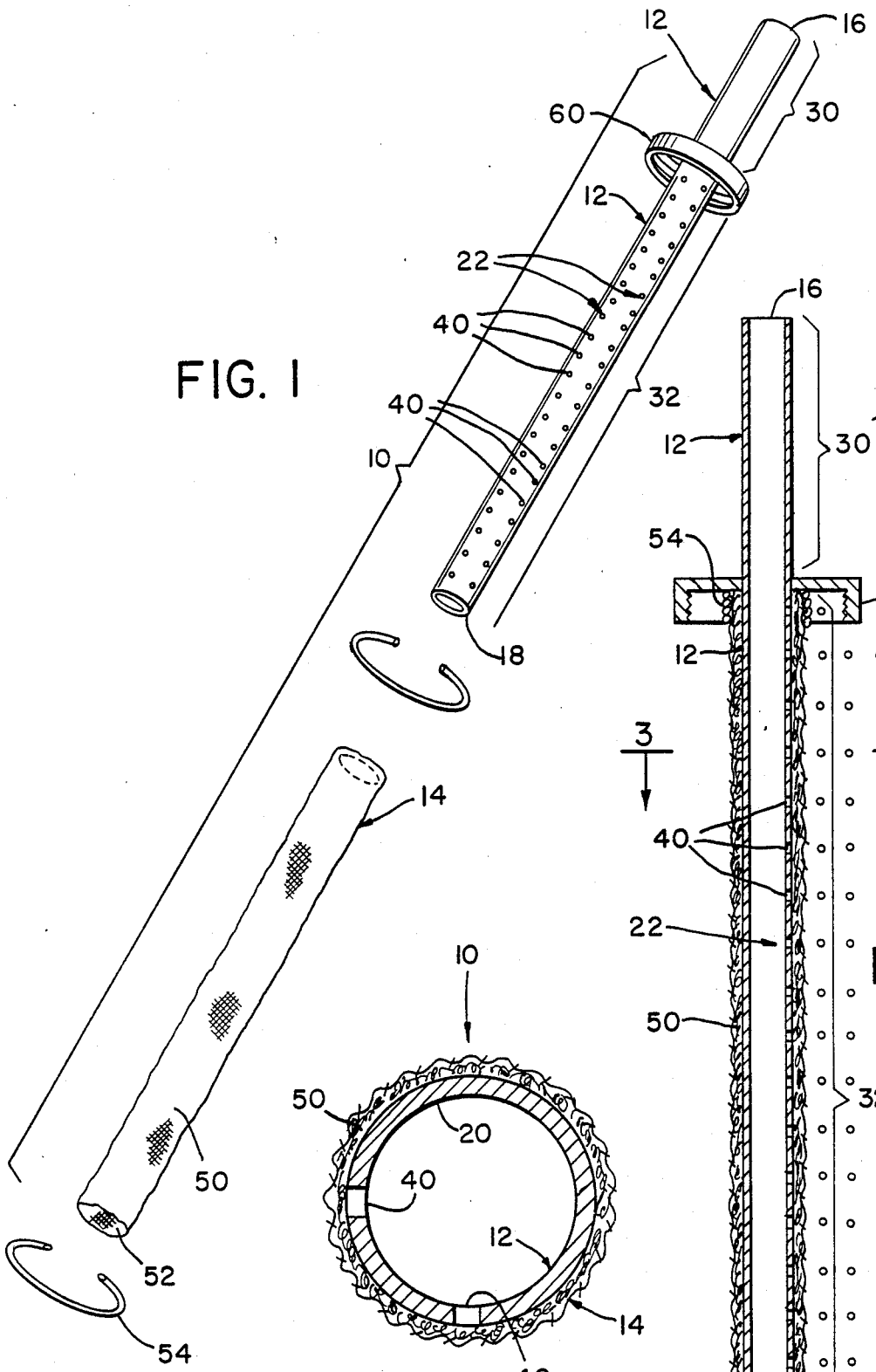
FIG. 1
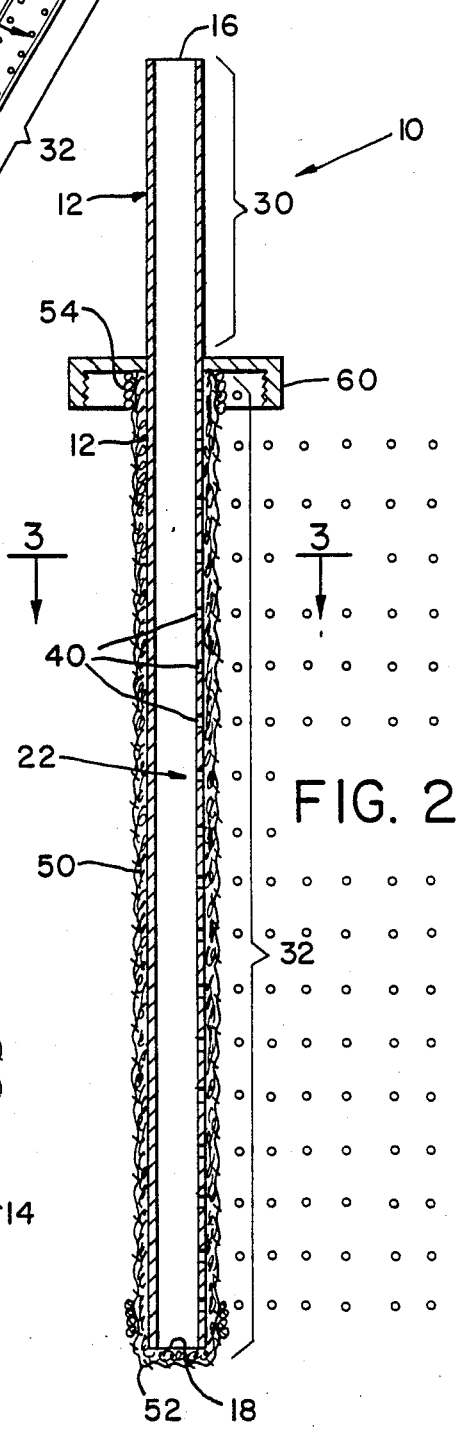
FIG. 2
FIG. 3

BUBBLE BEARD TOY

BACKGROUND OF THE INVENTION

The present invention relates to apparatus for blowing bubbles, and more particularly to an apparatus for producing from a bubble solution a beard of long, interconnected bubble chains.

Toys for use by children and the young at heart for producing soap bubbles are well known, as exemplified by U.S. Pat. Nos. 2,711,051; 3,590,515; 4,292,754 and 4,411,095. Typically, these devices produce single discrete bubbles rather than a long chain of interconnected bubbles. U.S. Pat. Nos. 3,443,337 and 4,606,731, however, disclose toys for the production of long, directionally-oriented, interconnected bubble chains. In each case, the device is of generally tubular configuration having a mouthpiece at one end through which the user blows, with the bubbles emerging from the opposite end like a stream of shaving foam emerging from an aerosol can of shaving cream. U.S. Pat. No. 3,443,337 in particular discloses that the end from which the bubbles emerge may be bifurcated (see FIGS. 13 and 14 thereof) or otherwise divided so that the bubbles emerge from that end in separate streams and then, depending upon the particulars of the configuration of that end, either remain separate or merge at a point downstream of that end.

Because in each embodiment of U.S. Pat. No. 3,443,337, the bubbles emerge from the hole in the end of the bubble-making apparatus as a directionally oriented chain, from whence they tend to droop toward the ground under the influence of gravity or are released into the air to float away, these prior art devices fail to provide an impression of the bubbles engulfing a substantial length of the device. The apparatus appears to be exactly what it is—that is, an apparatus for producing the bubbles—rather than providing the appearance and sense of becoming a part of the bubbles thus formed, as it would if the bubbles actually engulfed and surrounded a substantial length of the apparatus, both circumferentially and axially. Thus the need remains for apparatus for producing long, interconnected bubble chains which are not directionally oriented and form a fat "beard" on the apparatus by circumferentially surrounding a substantial portion of the axial length of the sidewall thereof.

Because in each embodiment of U.S. Pat. No. 3,443,337 the emerging bubbles emerge from the hole in the end of the bubble-making apparatus as a directionally oriented chain, unless they are filled with a lighter than air gas the bubbles upon release from the end of the bubble-making apparatus fail to float in the air with the ease and grace which would characterize a thinner, flatter mass of bubble chains. Thus the need remains for apparatus for producing long interconnected bubble chains which form a flat "beard" depending from the apparatus in a relatively thin, flat sheet.

Accordingly, it is an object of the present invention to provide apparatus which in one embodiment produces a beard of long, interconnected bubble chains which extends circumferentially about and axially along a substantial portion of the length of the sidewall of the apparatus to form a beard of bubbles.

It is another object to provide apparatus which in another embodiment produces such a beard of long interconnected bubble chains which is relatively flat and thin to facilitate floating of the beard in the air after its release from the apparatus.

SUMMARY OF THE INVENTION

It is now been found that the above and related objects of the present invention are obtained in apparatus for producing from a bubble solution a beard of long, interconnected bubble chains comprising a hollow elongate tube and a porous cloth. The hollow elongate tube has opposite ends and a sidewall connecting the opposite ends. The tube has at one end a first or imperforate portion adapted to receive a gas and at the opposite end a second or perforate portion defining a circumferentially spaced plurality of apertures extending through the sidewall and in gaseous communication with the imperforate portion. The porous cloth is disposed over and about each of the apertures and defines a multiplicity of substantially minute interstices for holding thin films of bubble solution. Gas introduced at the one tube end passes through the imperforate portion, into the perforate portion, and emerges laterally from the apertures through the bubble solution held in the cloth to form a beard of bubbles.

Preferably each of the apertures comprises either a narrow elongate slit extending substantially parallel to the axis of the tube for at least three inches (and optimally substantially the entire length of the perforate portion) or a spaced apart series of openings, the series extending substantially parallel to the axis of the tube for at least three inches (and optimally substantially the entire length of the perforate portion). The openings of a series are spaced apart by about $\frac{1}{8}$–2/8 inch and have a diameter of about 1 1/32–3/32 inch. The circumferentially spaced plurality of apertures are disposed either over not more than one quarter of the circumference of the perforate portion to produce a thin flat beard or over at least a half of the circumference (preferably equidistantly spaced) to produce a fat beard extending about the perforate portion.

In a preferred embodiment the perforate portion is longer than the imperforate portion and constitutes a substantial length of the tube. One end of the tube is configured and dimensioned as a mouthpiece to be received in a human mouth. The opposite end of the tube is either closed or cloth is also disposed completely thereover.

Preferably the cloth defines the multiplicity of substantially minute interstices on the surface proximate the perforate portion, and is substantially smooth on the surface remote from the perforate portion. The cloth is disposed on the outer surface of the sidewall over and about each of the apertures and is preferably French terry cloth.

The apparatus may additionally include closure means disposed at or adjacent the facing ends of the imperforate and perforate portions and extending laterally outwardly from the tube for substantially closing the opening of a container of bubble solution.

The present invention also encompasses the apparatus including bubble solution disposed in the interstices of the cloth.

BRIEF DESCRIPTION OF THE DRAWING

The above brief description, as well as further objects and features of the present invention, will be more fully understood by reference to the following detailed description of the presently preferred, albeit illustrative, embodiments of the present invention when taken in conjunction with the accompanying drawing wherein:

FIG. is an exploded isometric view of a first embodiment of apparatus according to the present invention;

FIG. 2 is a side elevational view of the apparatus, partially in cross section;

FIG. 3 is a top plan sectional view taken along the line 3—3 of FIG. 2, to an enlarged scale;

DETAILED DESCRIPTION OF THE PREFERRED EMBODIMENTS

Figure 5:
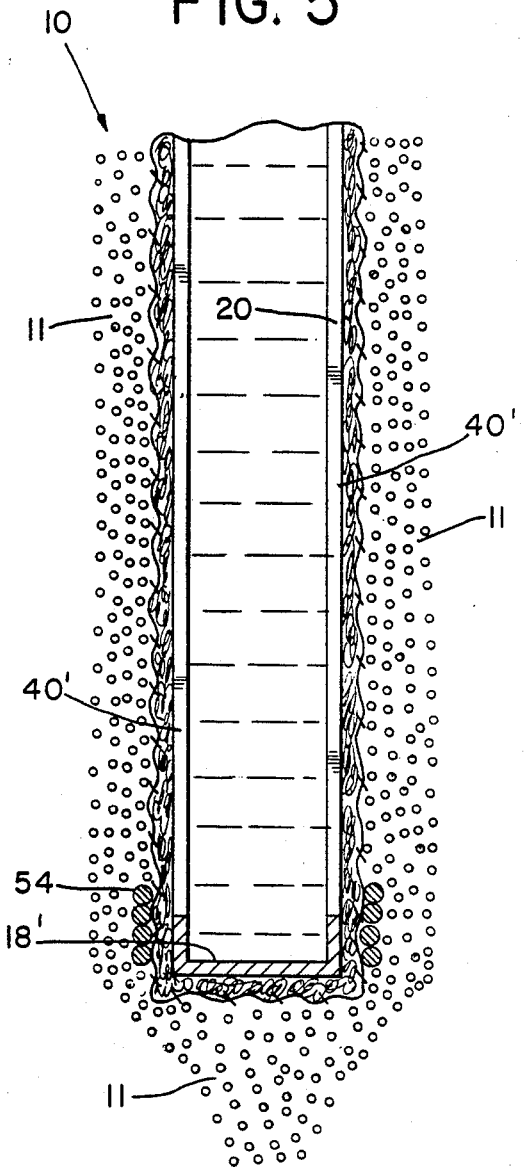
FIG. 5 is a fragmentary side elevational sectional view of the apparatus producing the beard, partially in cross section and to an enlarged scale, taken along the line 5—5 of FIG. 4.

Referring now to the drawing, and in particular to FIGS. 1–3 thereof, therein illustrated is apparatus according to the present invention, generally designated by the reference numeral 10, for producing a beard 11 of long, interconnected bubble chains from a bubble solution (see FIG. 5). The apparatus comprises a hollow elongate tube, generally designated 12, and a porous cloth, generally designated 14, disposed over one end of the tube 12.

More particularly, the hollow elongate tube 12 has opposed ends 16, 18 and a sidewall 20 connecting the ends 16, 18. While a cylindrical tube 12 having an outside diameter of about ½ inch is preferred, tubes of rectangular, square and other cross sectional configurations and dimensions are also operable. The portion of sidewall 20 adjacent the end 16 is typically configured and dimensioned as a mouthpiece to be received in the human mouth; typically the mouth of a small child. However, if desired, the end 16 may be adapted for connection to any source for blowing a gas (e.g., air or helium) thereinto. The portion of the sidewall 20 adjacent the mouthpiece end 16 is also preferably of sufficient length to enable it to be held by the user, so that the apparatus may conveniently be moved among various positions, first into a bubble solution, then into the mouth, and finally waved in the air to release a bubble beard. The portion of the sidewall 20 adjacent the opposite end 18 defines a circumferentially spaced plurality of apertures generally designated 22 extending through the sidewall 20 and in gaseous communication with the mouthpiece end 16 via the internal passageway defined by the sidewall 20.

Thus the tube 12 comprises two distinct portions, an imperforate portion 30 adjacent mouthpiece end 16 which does not contain any aperture 22 extending through its sidewall and a perforate portion 32 adjacent end 18 having at least one aperture 22 extending through its sidewall. The perforate tube portion 32 is at least three inches in length, constitutes a substantial length of the overall tube 12, and is preferably longer than the imperforate tube portion 30 along the axial length of the tube 12, although the latter is not essential. For a tube 9.5 inches in length, an imperforate portion 30 of about 3 inches and a perforate portion 32 of about 6.5 inches has been found to be particularly satisfactory, although other overall tube lengths and portion ratios are also operable.

In a first preferred embodiment of the present invention illustrated in FIGS. 1–3, each aperture 22 in turn comprises a spaced-apart series of openings 40, each series extending substantially parallel to the axis of the tube 12 for substantially the entire length of the perforate portion 32. Each opening 40 preferably has a diameter or maximum dimension of about 1/32–3/32 inch, most preferably 3/32 inch, with the openings 40 of the series preferably being spaced apart along the tube axis by about 1/8–2/8 inch. Interestingly, the number, size and spacing of the openings 40 have not been found to be critical factors determining the operability of the present invention. For example, in a second preferred embodiment of the present invention illustrated in FIGS. 4–5, each aperture 22 may alternatively comprise a narrow slit 40'. Again, while it is not critical, a preferred width of the slit 40' is about 1/32–3/32 inch, most preferably 3/32 inch. The aperture 22—whether a series of openings 40 or a slit 40'—extend lengthwise substantially parallel to the axis of the tube 12 for at least 3 inches and preferably for substantially the entire length of the perforate portion 32.

It is believed that the bubble chains produced by the air emerging from one opening 40 merge on the cloth 14 with the bubbles being produced by the air emerging from an adjacent opening 40 in the series where the spacing between the openings 40 is not in excess of ¼ inch. Thus the functional effect of the plurality of openings 40 in a series is similar to the effect produced by a single slit 40'. While the openings 40 have been shown as circular, openings of different configurations may also be used, including a plurality of axially aligned short slits. The exact number of openings 40 in a series is variable depending upon the size and configuration of each opening 40 and the spacing therebetween. The axial extension of the aperture 22—whether a series of openings 40 or a slit 40'—insures that the resultant beard will be relatively long. While a three inch minimum length of the aperture 22 suffices, the aperture 22 preferably extends the entire length of the perforate portion 32 so as to provide (as explained hereinafter) either the long fat beard which circumferentially engulfs the full length of perforate portion 32 or the long flat beard which is of a size to easily and gracefully float in the air after release from the apparatus.

In each embodiment 10, 10' there is a circumferentially spaced plurality of the apertures 22. In other words, in embodiment 10 there is a plurality of the spaced apart series of openings 40 and in embodiment 10 there is a plurality of slits 40', each series of openings 40 and each slit 40'extending-substantially parallel to the axis of the tube 12 for at least 3 inches and preferably for substantially the entire length of the perforate portion 32. A sufficient number of circumferentially spaced apertures 22 should be used to insure that the bubble chains produced by one aperture 22 connect and interconnect with the bubble chains produced by the circumferentially adjacent aperture 22.

Figure 4:
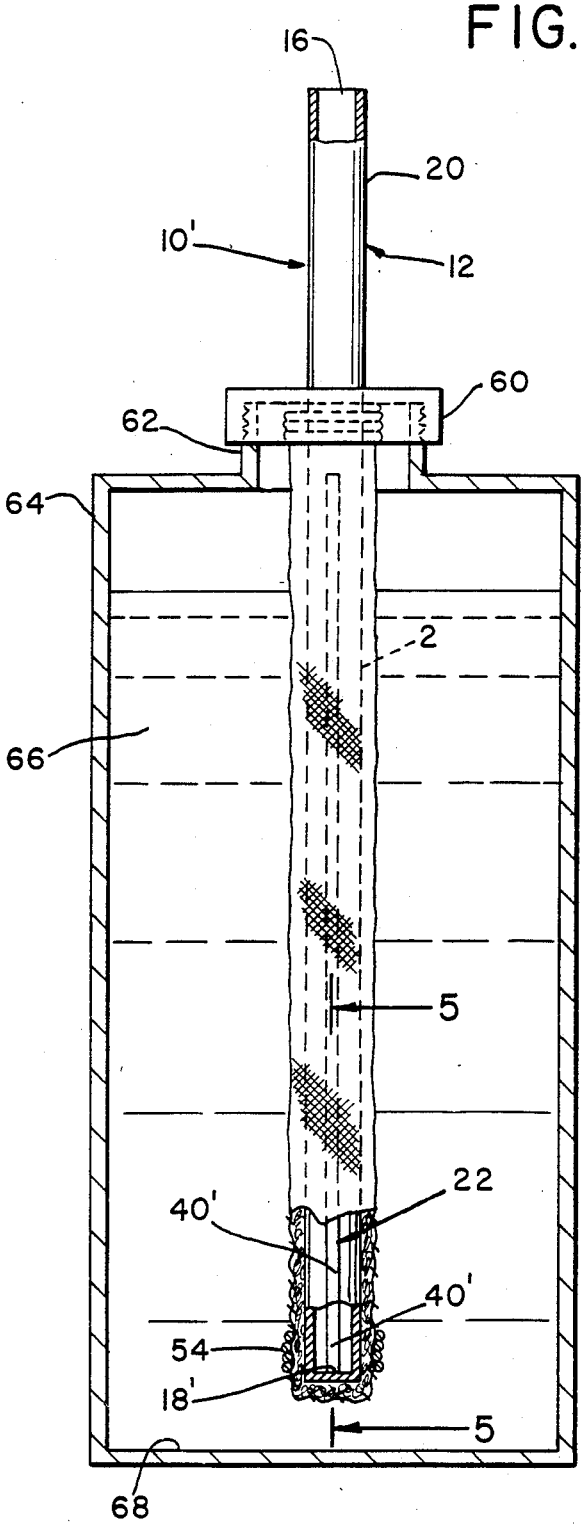
FIG. 4 is a side elevational view, partially in cross section and with layers removed to reveal details of internal construction, of a second embodiment of the apparatus positioned on a container of bubble solution.

Referring now in particular to FIGS. 4–5, the second embodiment 10' of the apparatus is intended to produce a "fat" beard which extends circumferentially about and axially along the perforate portion; accordingly, the apertures 22 are circumferentially spaced apart, preferably equidistantly, over at least one half of the circumference of the tube sidewall. On the other hand, referring now in particular to FIGS. 1–3, the first embodiment 10 of the apparatus is intended to produce a "flat" beard which upon discharge from the apparatus will waft easily and gracefully in the air; accordingly, the apertures 22 (whether two or more) are all be located within one quarter of the circumference of the tube sidewall 20—that is, the farthest apart of apertures 22 should at most define a right angle with the tube axis. With such a disposition of the apertures 22, the resultant bubble chains concentrate along a line parallel to the axis of the tube (rather than circling circumferentially around and engulfing the perforate portion) so that a relatively flat, relatively thin beard is produced. The flat beard is not only easier to separate from the apparatus by relative movement of the apparatus in the air, but it possesses a greater surface area so that it can be more easily supported by air, and even lifted by rising air currents. It will be appreciated that "flat" beards may also be produced using apertures 22 in the form of the slits 40' of second embodiment 10' and "fat" beards may also be produced using apertures 22 in the form of the series of openings 40 of the first embodiment 10.

The free end 18 of the perforate portion 32 may be either open or closed, an open end 18 being illustrated in connection with the first embodiment 10 in FIGS. 1 and 2, and a closed end 18' being illustrated in connection with the second embodiment 10' in FIGS. 4 and 5. Clearly, a closed end 18' may also be used in connection with apertures 22 in the form of a series of openings 40, and an open end 18 may also be used in connection with apertures 22 in the form of slits 40'. A closed end 18' is preferred, relative to an open end 18, because it channels the air flow through the passageway of tube 12 laterally through the apertures 22 to enhance the formation of bubbles along the length of the sidewall 20 of the perforate portion 32. However, again, this has not been found to be a critical factor, and a satisfactory lateral formation of bubbles is obtained even with an open end 18.

A porous cloth 14 is disposed over and about each of the apertures 22 (whether the apertures 22 be in the form of a series of openings 40 or a slit 40'), the cloth 14 covering each of the openings 40 or slits 40'. Where the perforate portion end 18 is open, the cloth 14 should also cover that end; where the perforate portion end 18' is closed, the cloth 14 may or may not cover that end. It is particularly convenient to use a sleeve of cloth which may conveniently be slipped over the end 18, 18 and sidewall 20 of the perforate portion 32 from the end 18, 18 thereof. One end 52 of the sleeve 50 may be closed so as to cover any open end 18 of the perforate portion 32. Opposite ends of the sleeve 50 may be secured to the perforate portion 32 by conventional means. For example, a fastening band 54 of string, plastic, wire or similar rust-proof material may be wrapped around each end of the sleeve 50 once it is appropriately positioned on the perforate portion 32. If desired, the outer surface of the portion 32 a circumferential groove (not shown) to receive the band 54 and prevent slippage thereof along the tube axis. Adhesives and other conventional securing means may be used instead of the fastener bands 54 so long as they do not unduly interfere with functioning of the cloth covering the apertures 22.

The cloth 14 may be formed of a variety of different materials, whether knitted or woven, defining a multiplicity of substantially minute interstices for holding thin liquid films of bubble solution. Preferably the cloth 14 defines the multiplicity of substantially minute interstices on the surface proximate the tube perforate portion 32 (that is, the inner surface of the cloth sleeve 50), while the cloth 14 is substantially smooth on the surface remote from the tube perforate portion 32 (that is, the outer surface of the cloth sleeve 50). Generally any laced, napped or looped cloth providing pores, piles, loops (either cut or uncut loops) or the like has been found to be satisfactory. A preferred knit material is terry cloth, a material commonly used for bath towels, bath robes and the like, with French terry cloth being especially preferred. Plastic or metal netting or screening may be used instead. The cloth is preferably, although not necessarily, flexible. It will be appreciated that the term cloth, as used herein and in the claims, has been used in a broad sense including organic and inorganic materials, regardless of whether they are knitted, woven or even deposited (for example, material deposited as a film and subsequently perforated to provide the desired multiplicity of minute interstices). Preferably the cloth is capable of entraining sufficient bubble solution to permit several beards to be blown successively upon the apparatus before re immersion of the cloth-covered perforate portion in bubble solution is required.

It is theorized that the presence of the cloth 14 not only over the apertures 22 but thereabout (i.e., not just over the openings 40 and slits 40' but thereabout as well) promotes joinder and interconnection of the individual bubble chains produced by the apertures 22 to form either the flat or fat beard, depending upon the relative disposition of the apertures 22.

Regardless of the particular dimensions and configurations of the apertures 22, the air escaping therethrough passes into the thin film of bubble solution held in the pores, piles or loops (i.e., minute interstices) of the cloth to form and develop initially a series of long, interconnected bubble chains extending to a degree both circumferentially and axially along the length of the perforate portion 32. As air continues to be blown through the apertures 22, the "beard" thus formed grows fatter or longer. Eventually a portion of the beard will droop under gravity and reach the floor if air pressure is continued for a sufficient period of time and there is adequate bubble solution trapped in the cloth interstices. Alternatively, if there is air flow at the outer surface of the perforate portion 32 (either because the tube is waved in still air or there is a moving current of air about the tube outer surface), a mass of interconnected bubble chains may be set free in the air.

Referring now in particular to FIG. 4, the apparatus 10, 10' optionally includes a downwardly-opening, cup like, internally-threaded closure member 60 disposed adjacent the junction of the imperforate and perforate portions 30, 32 of tube 12 and adapted to close the open top 62 of a container 64 having therein bubble solution 66. The closure means 60 enables the container 64 to be tilted substantially without bubble solution 66 escaping therefrom so as to enable utilization of a practically-empty container 64. While the closure means 60 still permits escape of the bubble solution 66 through the passageway of a tube 12 having an open end 18', this too may be avoided, if desired, by selecting the length of the perforate portion 32 relative to the height of the container 64 so that the upper surface of the container bottom 68 effectively closes the open end 18' when the closure means 60 is screwed onto the open top 62 of container 64. The bubble solution may be a commercial bubble solution or a home made mixture of water and detergent, preferably with glycerine.

The apparatus of the present invention is used by dipping the cloth-covered perforate portion 32 into bubble soap solution 66 all the way to the top of the cloth 14. The apparatus is then removed from the bubble solution 66 and allowed to drip for a moment. Then the mouthpiece end 16 of the imperforate portion 30 is brought into or against the mouth of the user, and the user blows softly in long, slow breaths. Foam will begin to flow laterally out of the cloth 14 covering the sidewall 20. Depending on the disposition of the apertures 22, the foam may extend circumferentially about and along the perforate portion 32 to form a fat beard or may extend as a long, flat depending sheet of foam to form a flat beard. The tube may be waved in the air to release the beard into the air. If desired, the mouthpiece end 16 may be connected to a source of helium to produce a lighter than air foam which will ascend when the foam is released from the apparatus 10, for example, by waving the apparatus 10 in the air.

To summarize, the present invention provides apparatus which in one embodiment produces a fat beard of bubbles which extends circumferentially about and axially along a substantial portion of the length of the apparatus, so that the apparatus becomes a part of the beard rather than merely a means of producing the same, and in another embodiment produces a flat beard of bubbles which is relatively long and flat so that, once released into the air from the apparatus, it wafts with relative ease and grace.

Now that the preferred embodiments of the present invention have been shown and described in detail, various modifications and improvements thereon will become readily apparent to those skilled in the art. Accordingly, the present invention is to be construed broadly and in a manner consistent with the spirit and scoop of the invention herein.

I claim:

1. Apparatus for producing from a bubble solution a beard of long, interconnected bubble chains comprising:

(A) a hollow elongate tube having opposite ends and a sidewall connecting said opposite ends, said tube having at one end an imperforate portion adapted to receive a gas and at the opposite end a perforate portion defining a circumferentially spaced plurality of apertures extending through said sidewall and in gaseous communication with said imperforate portion; and (B) porous cloth disposed over and about each of said apertures, said cloth defining a multiplicity of substantially minute interstices for holding thin films of bubble solution;

whereby gas introduced at said one tube end passes through said imperforate portion, into said perforate portion, and emerges laterally from said apertures through the bubble solution held in said cloth to form a beard of bubbles.

2. The apparatus of claim 1 wherein said plurality of apertures are disposed over no more than one quarter of the circumference of said perforate portion to produce a thin flat beard.

3. The apparatus of claim 1 wherein said plurality of apertures are disposed over at least one half of the circumference of said perforate portion to produce a fat beard extending about the circumference thereof.

4. The apparatus of claim 1 wherein each of said apertures comprises a narrow elongate slit extending substantially parallel to the axis of said tube at least three inches.

5. The apparatus of claim 4 wherein said slit extends for substantially the entire length of said perforate portion.

6. The apparatus of claim 4 wherein said slit has a width of about 1/32–3/32 inch.

7. The apparatus of claim 1 wherein each of said apertures comprises a closely spaced apart series of openings, said series extending substantially parallel to the axis of said tube at least three inches.

8. The apparatus of claim 7 wherein said series extends for substantially the entire length of said perforate portion.

9. The apparatus of claim 7 wherein said openings of a series are axially spaced apart by about $\frac{1}{8}$–2/8 inch and have a maximum dimension of about 1/32–3/32 inch.

10. The apparatus of claim 1 wherein said perforate portion is longer than said imperforate portion and constitutes a substantial length of said tube.

11. The apparatus of claim 1 wherein said cloth is also disposed completely over said opposite end of said tube.

12. The apparatus of claim 1 additionally including closure means disposed at or adjacent the facing ends of said imperforate and perforate portions and extending laterally outwardly from said tube for substantially closing the opening of a container of bubble solution.

13. The apparatus of claim 1 wherein the one end of said tube is configured and dimensioned as a mouthpiece to be received in a human mouth.

14. The apparatus of claim 13 wherein said tube has an outside diameter of about 0.5 inch.

15. The apparatus of claim wherein said cloth defines said multiplicity of substantially minute interstices on the surface proximate said perforate portion.

16. The apparatus of claim 14 wherein said cloth is substantially smooth on the surface remote from said perforate portion.

17. The apparatus of claim wherein said cloth is French terry cloth.

18. The apparatus of claim 1 additionally comprising bubble solution disposed in said interstices of said cloth.

19. The apparatus of claim wherein said cloth is disposed on the outer surface of said sidewall over and about each of said apertures.

20. The apparatus of claim 1 wherein said opposite end of said tube is closed.

21. Apparatus for producing from a bubble solution a beard of long, interconnected bubble chains extending about and along a substantial length of the apparatus, comprising:

(A) a hollow elongate tube having opposite ends and a sidewall connecting said opposite ends, said tube having at one end an imperforate portion configured and dimensioned as a mouthpiece to be received in a human mouth and adapted to receive air blown therein by the user and at the opposite end a perforate portion defining a circumferentially spaced plurality of apertures extending through said sidewall and in gaseous communication with said first portion, said perforate portion constituting a substantial length of said tube;

(B) a porous cloth of absorbent material disposed on the outer sidewall of said tube over and about each of said apertures and completely over said opposite end of said tube, said cloth defining on the surface proximate said perforate portion a multiplicity of substantially minute interstices for holding thin films of bubble solution and being substantially smooth on the surface remote from said perforate portion; and (C) bubble solution disposed in said interstices of said cloth;

whereby air introduced at said one tube end passes through said imperforate portion into said perforate portion and emerges laterally from said apertures through said bubble solution held in said cloth to form a beard of bubbles.

22. The apparatus of claim 21 wherein each of said apertures comprises a narrow elongate slit extending substantially parallel to the axis of said tube for substantially the entire length of said perforate portion.

23. The apparatus of claim 21 wherein each of said apertures comprises a spaced apart series of openings, said series extending substantially parallel to the axis of said tube portion for substantially the entire length of said perforate portion, said openings of a series being spaced apart by about 1/8–2/8 inch and having a maximum dimension of about 1/32–3/32 inch.

24. The apparatus of claim 21 wherein said plurality of apertures are disposed over no more than one quarter of the circumference of said perforate portion to produce a thin flat beard.

25. The apparatus of claim 21 wherein said plurality of apertures are disposed over at least one half of the circumference of said perforate portion to produce a fat beard extending about the circumference thereof.

* * * * *